US005538452A

United States Patent [19]

Kurani

[11] Patent Number: 5,538,452

[45] Date of Patent: Jul. 23, 1996

[54] PUZZLE TOY WITH HINGE-LINKED MEMBERS

[76] Inventor: Nadim K. Kurani, P.O. Box 9913, Newport Beach, Calif. 92658-9913

[21] Appl. No.: 406,563

[22] Filed: Mar. 20, 1995

[51] Int. Cl.[6] ..... A63H 33/12; A63H 33/08; A63H 33/00

[52] U.S. Cl. ..... 446/102; 446/109; 446/124; 446/487

[58] Field of Search ..... 446/102, 104, 446/109, 111, 116, 120, 121, 124, 125, 487, 486, 490; 273/153 S, 155, 156, 160, DIG. 12

[56] References Cited

U.S. PATENT DOCUMENTS

| | | | |
|---|---|---|---|
| 176,144 | 4/1876 | McDougall . | |
| 3,201,894 | 8/1965 | Resch | 446/487 |
| 3,496,670 | 2/1970 | Sloop et al. | 446/104 |
| 3,523,384 | 11/1970 | Adelsohn . | |
| 3,550,310 | 12/1970 | Bock-Greissau | 446/487 X |
| 3,611,620 | 10/1971 | Perry | 446/121 |
| 3,672,681 | 6/1972 | Wolf . | |
| 3,681,870 | 8/1972 | Alpert . | |
| 3,803,754 | 4/1974 | Fischer . | |
| 3,811,682 | 5/1974 | Neale et al. | 273/DIG. 12 X |
| 3,815,280 | 6/1974 | Gilfillan | 446/487 |
| 4,051,621 | 10/1977 | Hogan | 446/122 |
| 4,055,019 | 10/1977 | Harvey . | |
| 4,114,307 | 9/1978 | Liebeskind | 446/487 |
| 4,633,607 | 1/1987 | Brasch et al. | 446/487 X |
| 4,822,315 | 4/1989 | Ben-Gal et al. . | |
| 4,875,681 | 10/1989 | Ofir | 446/487 X |
| 5,106,093 | 4/1992 | Engel . | |
| 5,302,148 | 4/1994 | Heinz | 446/486 X |

*Primary Examiner*—Mickey Yu
*Assistant Examiner*—D. Neal Muir
*Attorney, Agent, or Firm*—Price, Gess & Ubell

[57] ABSTRACT

A construction/puzzle toy comprised of pairs of half-polyhedrons that are connected along one margin by a living plastic hinge. A chain is formed by permanently attaching adjacent pairs to each other by an axle-like component that rotatably joins two half-polyhedrons to form an entire polyhedron. This combination of a rotatable joint within each whole polyhedron and a hinge joint between adjacent polyhedrons allows the chain to be rearranged into a large number of different shapes. A preferred assembled shape for a chain of the polyhedrons is that of a cube. A closed ring of eight cuboidal polyhedrons forms a challenging puzzle that can be reconfigured to form a large cube with four cuboidal polyhedrons on each face. Likewise, a closed chain of 27 cubes can create a large cube with 9 cuboidal polyhedrons per face. Chains that are not closed to form a ring can be used to construct a wide variety of interesting shapes. The invention can be equipped with small knob-shaped tips to the axle-like component. The tips interact with small apertures to removably attach adjacent polyhedrons to each other.

11 Claims, 2 Drawing Sheets

PUZZLE TOY WITH HINGE-LINKED MEMBERS

BACKGROUND OF THE INVENTION

1. Field of the Invention

This invention concerns the field of puzzle or construction toys and, more specifically, a three-dimensional structure of linked members that can be readily reconfigured into a plurality of forms including geometrical forms such as a cube which represent solutions to the puzzle.

2. Description of Related Art

Various types of three-dimensional puzzles or construction toys have long been popular. The simple progenitor of construction toys, puzzle or otherwise, is probably the simple building block. Wooden puzzles consisting of a plurality of variously-shaped parts that assemble to form a cube, a sphere, or even an animal have been produced in the Orient for many generations. A recent pastime (or scourge, depending on one's disposition) has been puzzles of the Rubic's cube-type in which planes of a cubic structure are rotatable so that cube sides of a single color can be assembled.

Three-dimensional puzzles have ranged from simple solid figures in which the individual pieces can be linked by flexible rods which fit into complementary holes, as taught in U.S. Pat. No. 3,523,384 to Adelsohn, to diabolical puzzles in which a large geometric shape is assembled from a plurality of smaller pieces, as taught in U.S. Pat. No. 3,672,681 to Wolf.

Three-dimensional construction toys typically consist of a plurality of pieces, each equipped with one or more complementary attachment structures whereby the pieces may be linked to create a variety of larger structures. U.S. Pat. No. 3,803,754 to Fisher teaches a system in which prismatic building blocks can be assembled into larger geometric shapes by means of resilient connecting elements. U.S. Pat. No. 4,055,019 to Harvey discloses a planar building element that can be linked into a variety of shapes by means of mating margins whereby a pip on one element fits into a socket on an adjacent element to create a detachable hinge. U.S. Pat. No. 4,822,315 to Ben-Gal et al. teaches another planar building element linked into a variety of shapes by hook-like projections on one element that interact with slot-like openings on adjacent elements.

The construction-type toy is combined with the puzzle-type toy in U.S. Pat. No. 5,106,093 to Engel, which discloses a puzzle of cube-like pieces that interconnect by a key-in-keyhole arrangement. This ability to interconnect allows a variety of different shapes to be assembled. The insertion of the "key" of one piece into the "keyhole" of another piece causes the two pieces to become locked together until the "key" of a third piece is inserted into a second "keyhole" on one of the original pieces, thereby releasing the originally locked pieces. The trick is to assemble the pieces in the correct order so as to create a large cube with all pieces firmly locked together.

A major drawback to the construction toys and puzzles discussed heretofore is that they all comprise a plurality of separate pieces. Therefore, it is quite easy to lose one or more of the pieces. In the case of a construction toy this is usually merely an annoyance as such a loss renders the toy less able to create a variety of forms. Of course, in some cases the missing piece may be ingested by a small child, presenting a choking hazard. However, in the case of a puzzle toy, the loss of a single piece may not only present the physical hazards just alluded to, but also renders the toy useless, since the puzzle can no longer be solved.

OBJECTS AND SUMMARY OF THE INVENTION

It is a object of the present invention to provide an easily manufactured component that can be used either to create construction toys or puzzle toys;

It is a further object of the present invention to provide a system whereby the pieces of the construction toy or the puzzle toy cannot be readily lost or ingested by a child; and It is another object of the present invention to provide means whereby the pieces of a construction toy can be easily rearranged and yet be temporarily fixable in one configuration.

These and other objects are met by a construction/ puzzle toy comprised of pairs of half-polyhedrons that are connected along one margin by a living plastic hinge. A chain is formed by permanently attaching adjacent pairs to each other by an axle-like component that rotatably joins two half-polyhedrons to form an entire polyhedron. This combination of a rotatable joint within each whole polyhedron and a hinge joint between adjacent polyhedrons allows the chain to be rearranged into a large number of different shapes. A preferred shape for the entire polyhedron is that of a cube. A closed ring of eight cuboidal polyhedrons forms a challenging puzzle that can be reconfigured to form a large cube with four of the cuboidal polyhedrons exposed on each face. Likewise, a closed chain of 27 cuboidal polyhedrons can create a large cube with 9 polyhedrons per face. Chains that are not closed to form a ring can be used to construct a wide variety of interesting shapes.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a three-dimensional construction toy or puzzle comprising a chain of hinge-linked polyhedrons, the hinge position of each polyhedron being rotatable relative to one another.

The present invention takes advantage of the well-known property of certain plastic materials such as polypropylene to form "living hinges." What is meant by a living hinge is a special planar hinge-like connection between two plastic structures. If the structures are molded so as to be connected by along straight portions of each structure, the structures may be repeatedly moved relative to one another along the juncture. A relatively thin strip of the plastic material connecting the structures is amazingly strong and does not show fatigue even after a large number of flexings. Instead the molecular structure of a living hinge is such that linear chains of molecules may actually enhance the hinge strength with added use. Thus, a hinge-like connection can be created by the same molding process that forms the structures.

Figure 1:
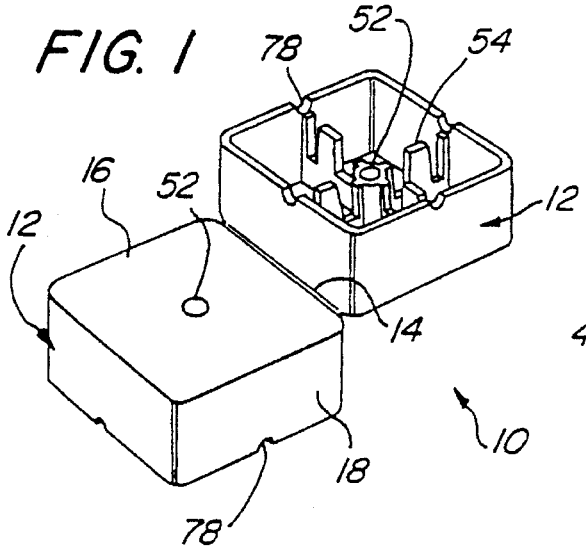
FIG. 1 shows a perspective view of a hinged half-polyhedron unit of the present invention.

FIG. 1 shows a hinged half-polyhedron unit 10 of the present invention. This unit 10 is molded from polypropylene or a similar plastic material and comprises two half-polyhedron members 12 connected by a living hinge 14. Each half-polyhedron member 12 comprises an end face 16 and four half-faces 18 perpendicular to the end face 16. As will be explained more fully below, two half-polyhedron members 12 can be joined to form a complete polyhedron 20.

Figure 2:
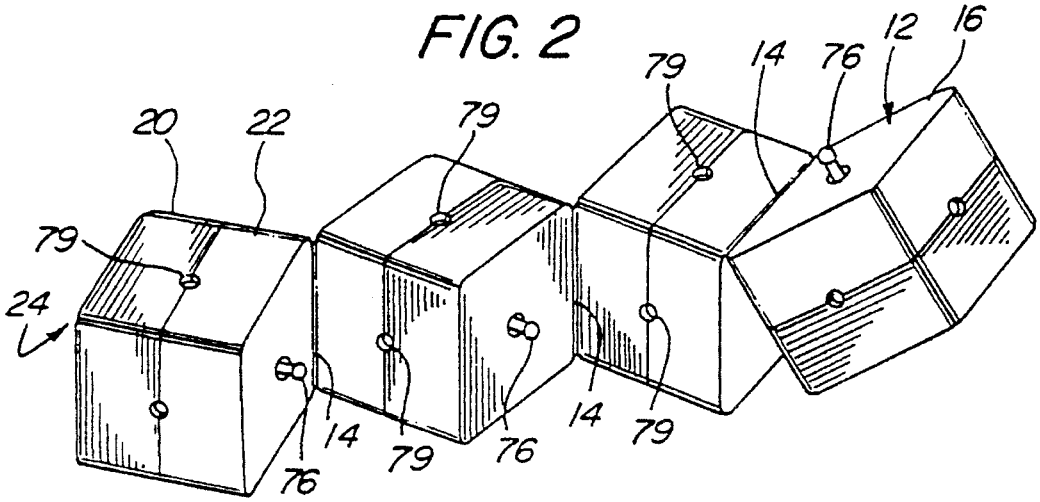
FIG. 2 shows an open linear chain of polyhedrons constructed from the hinged half-polyhedron units of FIG. 1.
Figure 4A:
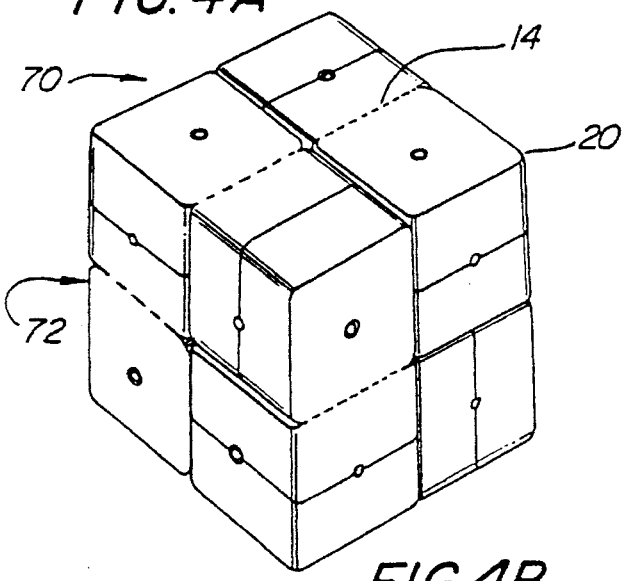
FIG. 4A shows a view of a cube assembled from a closed chain of eight polyhedrons.
Figure 4B:
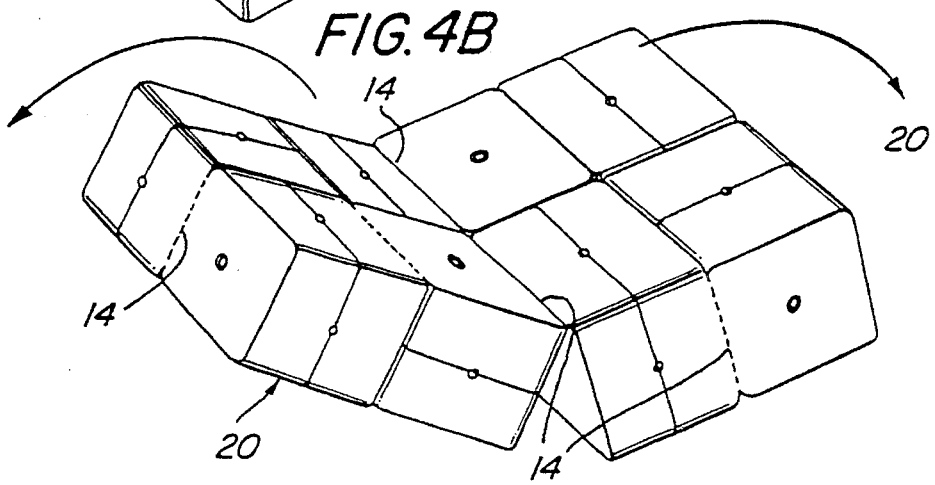
FIG. 4B shows the cube of FIG. 4A somewhat distorted to reveal the hinges between the polyhedrons.
Figure 4C:
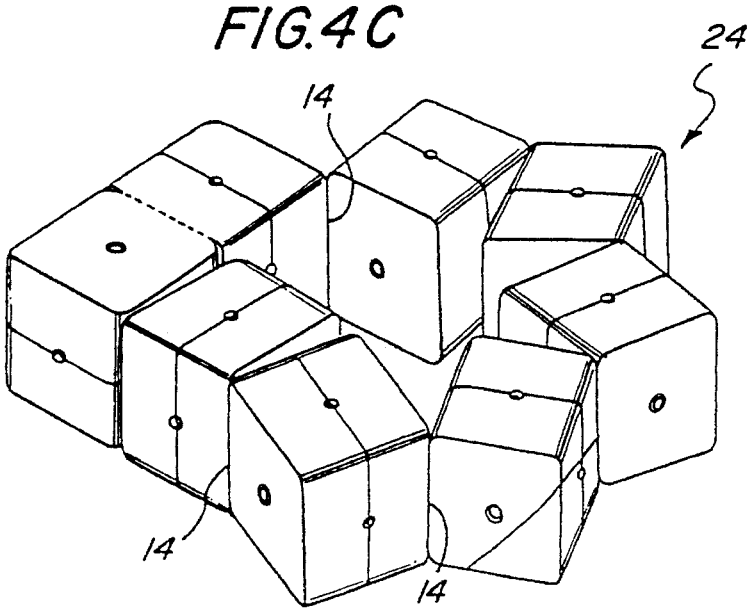
FIG. 4C shows the polyhedrons of the chain of FIG. 4A rearranged to obscure the cube.

In this preferred embodiment the complete polyhedron 20 is a cube. A cube has six faces; there are two end faces 16, each provided by one of the half-polyhedron members 12 and four side faces 22, each formed by one half-face 18 from each of the joined half-polyhedron members 12. A chain 24 of polyhedrons 20 (FIG. 2) is formed by joining a series of hinged half-polyhedron units. The chain 24 can be linear, as shown in FIG. 2, or can be a loop, as shown in FIG. 4C.

Figure 3A:
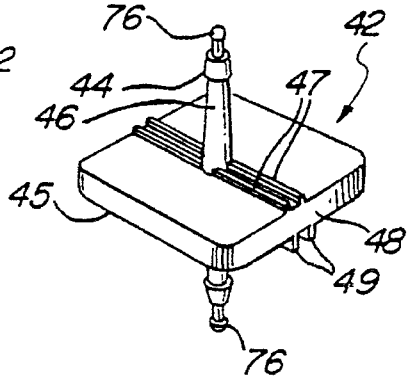
FIGS. 3A, 3B show an axle that can be used to join the hinged half-polyhedron units of FIG. 1.
Figure 3B:
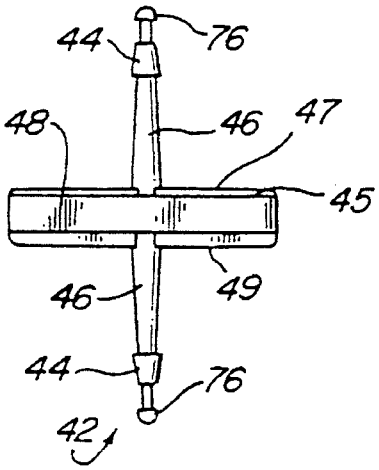

The half-polyhedron members 12 are joined by an axle 42 to form complete polyhedrons 20. As illustrated in FIGS. 3A, 3B, the axle 42 has an arrow-shaped protruding collar 44 at each end of the axle shaft 46. The ends of the axle shaft 46 are inserted into cylindrical bearing passageways 52 in each half-polyhedron member 12. The axle 42 is molded from a hard, relatively inflexible plastic such as ABS. A constriction in each bearing passageway 52 retains the protruding collar 42, while allowing the half-polyhedron member 12 to rotate freely on the axle 42.

In addition, the axle 42 has a planar, expanded detente region 48 bearing shallow detentes 47 on one surface thereof and deep detentes 49 on the opposite surface. The detentes 47, 49 interacts with pawls 54 to cause rotation about the axle 42 to preferably stop with the half-faces 18 aligned to constitute a full side face 22. Thus, the two joined half-polyhedron members 12 are preferentially aligned to form full polyhedrons 20 with the pawls 54 trapped between the detentes 47, 49.

Because the pawls 54 are molded from resilient plastic, they will flex and allow the detentes 47, 49 to ride over them when the half-polyhedron members 12 are twisted in opposite direction with sufficient force. Thus, a slight rotary force on the half-polyhedron members 12 is resisted, while a greater force causes the detentes 47, 49 to override the pawls 54 with a loud click. Actually, the shallow detentes 47 preferentially override the pawls 54 while the axle 42 remains locked in place relative to the half-polyhedron member 12 on the side of the deep detente 49. Because the motion is restricted to one set of detentes, the click sound is more distinct and unitary. The hollow structure of the half-polyhedron members 12 acts as a resonator to amplify this sound.

Once freed from the shallow detente 47, the half-polyhedron member rotates relatively freely for about 90 degrees until it encounters the next pawl 54. This 90-degree spacing of the pawls 54 ensures that the half-polyhedron faces 18 are preferentially aligned to form entire side faces 22. When the invention is used to create polyhedrons other than cubes, the pawls 54 are spaced apart 360/x degrees, where x equals the total number n of faces in the polyhedron minus two (the two end faces 16). Thus, an octahedron (eight-surface polyhedron) would have two end faces and six side faces (n–2=6) and would have pawls 54 spaced 360/6=60 degrees apart.

In the preferred embodiment the planar detente region 48 has a four-sided (square) shape essentially congruent with that of the end faces 12. This configuration adds an additional detente effect. When the axle 42 is turned 45 degrees from interaction between the detentes 47 and the pawl 54, corners 45 of the planar detente region 48 interact with inner surfaces of the half-faces 18, providing an additional restriction to the free rotation of the half-polyhedron members 12. As the half-polyhedron members 12 are rotated, the interaction between the detente 47 and the pawl 54 first resists turning. Then, with a loud click, the detente 47 overrides the pawl 54 and the half-polyhedron member 12 moves freely until a resistance is felt at the 45-degree position as the corners 45 interact with the half-faces 18. A slight increase in force overcomes this resistance and the half-polyhedron member 12 rotates easily until the detente 47 and the pawl 54 click together at the 90-degree position.

This arrangement where the half-polyhedron members 12 are rotatable in relation to each other is ideal for creating a three-dimensional puzzle. For instance, FIG. 4A shows a closed chain 24 of eight polyhedrons 20 configured to form a large cube 70 with four polyhedrons 20 visible on each face 72 of the large cube 70. FIG. 4B shows the positions of the living hinges 14 that connect the polyhedrons 20. FIG. 4C shows that by rotating several of the half-polyhedron members 12 relative to each other, the positioning of the living hinges 14 is completely changed and the large cube 70 is totally obscured. Reassembling the large cube 70 can present a significant challenge. The overall appearance can be enhanced by making the hinged half-polyhedron units 10 out of different colors and arranging adjacent half-polyhedron units 10 to be of different and preferably complementary or contrasting colors. The use of two contrasting colors is especially effective with cuboidal polyhedrons 20 because the overall look is of an alternating or checkerboard appearance.

An even more daunting puzzle can be made with a chain 24 of twenty-seven polyhedrons 20 which can be assembled into a very large cube with nine polyhedrons 20 visible on each face (not illustrated). The example of FIG. 4 is created using a closed chain of polyhedrons 20 because the interaction between the polyhedrons 20 in a closed chain makes the puzzle somewhat more difficult. Of course, perfectly acceptable puzzles can also be created using an open chain.

A second use for the present invention is as a construction toy. In this embodiment the chain 24 of polyhedrons 20 is usually open-ended as in FIG. 2. However, a similar effect can be obtained with a long (more than about fifteen polyhedrons 20) closed-loop chain 24. With such a chain 24 it is possible to rotate and hinge the polyhedrons 20 into a number of different structures. Because the pieces are all hinged together, there is little danger of losing parts as with many common construction toys.

One small problem is that the living hinges 14 preferentially move into an extended position with the two half-polyhedron members 12 of each hinged half-polyhedron unit 10 lying at approximately right angles to each other as in FIG. 1. Therefore, a retainer system is advantageously included to allow the polyhedrons 20 to maintain a position against the natural tendency of the living hinges 14 to assume an extended position.

Figure 5:
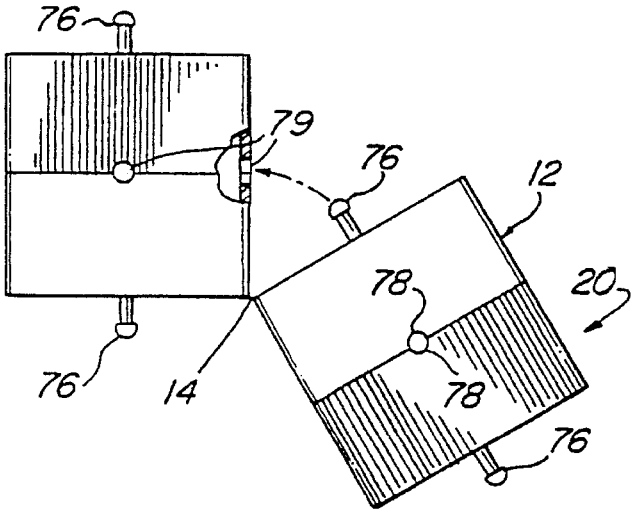
FIG. 5 shows a retainer system used to removably fix the polyhedrons in place so that the present invention can be used as a construction toy.

For open chains, the preferred embodiment of the axle shaft 44 bears a small knob 76, as seen in FIG. 5. This knob extends out from the end face 16 by means of the bearing passageway 52 which completely penetrates the end face 16. This knob 76 is sized to interact with a retainer aperture 79 that is formed from two half-retainer apertures 78 that are brought together when the half-faces 18 are aligned to form full side faces 22. The knob 74 is able to snap into the retainer aperture 78 to removably hold the end face 16 of one polyhedron 20 against the side face 22 of an adjacent polyhedron 20. This allows a variety of structures to be readily constructed. It also allows a number of different chains 24 to be removably attached to each other. Of course, other interlocking structures such as small tabs inserted into slots can also be employed to achieve this result. When the invention is employed in puzzles (as in FIG. 1), the knob 74 may be omitted.

The foregoing illustrated examples have utilized a regular polyhedron for the entire polyhedrons 20. However, excellent construction toys can be produced where the polyhedrons are irregular or rounded even to the point of forming spherical, elliptical or "blob-like" organic shapes. Irregular polyhedrons 20 of several different shapes and sizes can be included in a single chain. Such a toy will not pack to form larger geometric figures such as cubes, but the pieces can be configurable to create interesting organic forms such as humanoid figures, etc. When the individual polyhedrons 20 are irregular in shape, the hinges 14 are generally of a much shorter length since there are few straight edges to form a hinge.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A puzzle toy formed as a linear chain of hinge-connected polyhedrons, the puzzle toy comprising:

a plurality of hinged half-polyhedron units, each unit comprising:

a first half-polyhedron member having a substantially straight edge;

a second half-polyhedron member having a substantially straight edge aligned with the edge of the first half-polyhedron member; and a hinge connecting the two half-polyhedron members, edge to edge;

an axle rotatably retained at a first end and a second end, respectively, by the first and the second half-polyhedron member, for rotatably joining each half-polyhedron member of one hinged half-polyhedron unit to one half-polyhedron member of a different hinged half-polyhedron unit forming a hingedly connected chain of full polyhedrons;

detente means on the axle; and pawl means on the half-polyhedron members for interacting with the detente means to provide a restriction to rotation of the half-polyhedron members in relation to each other.

2. The puzzle toy of claim 1, wherein each half-polyhedron member further comprises a retaining means for detachably holding a first full polyhedron substantially in contact with a second full polyhedron when the two polyhedrons are moved into contact by flexing the hinge.

3. The puzzle toy of claim 1, wherein the hinged half-polyhedron units are molded from polypropylene.

4. A puzzle toy formed as a linear chain of hinge-connected polyhedrons of n faces, the puzzle toy comprising:

a plurality of hinged half-polyhedron units, each unit comprising:

a first half-polyhedron member having one end face with n–2 edges and n–2 half-faces, each half-face depending from one edge;

a second half-polyhedron member substantially similar to the first half-polyhedron member; and a hinge connecting the two half-polyhedron members, edge to edge;

an axle which is rotatably retained at a first end and a second end, respectively, by a first polyhedron member and a second half-polyhedron member of a different hinged half-polyhedron unit forming a chain of full polyhedrons of n faces each, each full polyhedron hingedly connected to up to two other polyhedrons;

detente means on the axle; and pawl means on the half-polyhedron members for interacting with the detente means to provide a restriction to rotation of the half-polyhedron members preferentially aligning the half-faces in relation to each other every x degrees, where x=360/n.

5. The puzzle toy of claim 4, wherein n equals six and the polyhedron formed by joining two hinged half-polyhedron members is a cube.

6. The puzzle toy of claim 4, wherein each end face further comprises a retaining means for interacting with the joined half-faces of a different full polyhedron detachably holding the end face and the joined half-faces substantially in contact when the end face and the joined half-faces are moved into contact by flexing the hinge connecting the polyhedrons.

7. The puzzle toy of claim 4, wherein the hinged half-polyhedron units are molded from polypropylene.

8. A puzzle toy formed as a chain of hinge-connected cuboidal polyhedrons, the puzzle toy comprising:

a plurality of hinged half-polyhedron units, each hinged half-polyhedron unit comprising:

a first half-polyhedron member having a square end face with four half-faces, each half-face depending at approximately right angles from an edge of the square end face;

a second half-polyhedron member substantially similar to the first half-polyhedron member; and a hinge connecting the two half-polyhedron members, an edge of the first half-polyhedron member to an edge of the second half-polyhedron member;

an axle member rotatably retained at a first end and at a second end by hinged half-polyhedron members for rotatably joining each hinged half-polyhedron member of one hinged half-polyhedron unit to one half-polyhedron member of a different hinged half-polyhedron unit forming a chain of cuboidal polyhedrons, each polyhedron hingedly connected to up to two other polyhedrons;

a retention tip at either end of the axle member and protruding slightly from a center of each square end face when the hinged half-polyhedrons are joined by the axle member;

a retention aperture formed in a center of half-faces when the half-hinged polyhedrons are aligned to make a cube, the retention aperture sized and positioned to removably retain the retention tip when the hinge is flexed to bring the retention tip and the retention aperture into contact whereby the polyhedrons can be removably joined together;

a detente on the axle member; and a pawl on each half-polyhedron member for interacting with the detente to provide a restriction, every 90 degrees, to rotation of the half-polyhedron members in relation to each other, so that the half-faces are preferentially aligned to form an entire cube.

9. The puzzle toy of claim 8, wherein the hinged half-polyhedron units are molded from polypropylene.

10. A puzzle toy formed as a ring of hinge-connected cuboidal polyhedrons, the puzzle toy comprising:

a plurality of hinged half-polyhedron units, each hinged half-polyhedron unit comprising:

a first half-polyhedron member having a square end face with four half-faces, each half-face depending at approximately right angles from an edge of the square end face;

a second half-polyhedron member substantially similar to the first half-polyhedron member; and a hinge connecting the two half-polyhedron members, an edge of the first half-polyhedron member to an edge of the second half-polyhedron member; and an axle member rotatably retained at a first end and at a second end by hinged half-polyhedron members for rotatably joining each hinged half-polyhedron member of one hinged half-polyhedron unit to one half-polyhedron member of a different hinged half-polyhedron unit forming a chain of cuboidal polyhedrons, wherein the axle member further comprises a detente and wherein the half-polyhedron members further each comprise a pawl for interacting with the detentes to provide a restriction, every 90 degrees, to rotation of the half-polyhedron members in relation to each other, so that the half-faces are preferentially aligned to form entire cubes.

11. The puzzle toy of claim 10, wherein the hinged half-polyhedron units are molded from polypropylene.

* * * * *